US010026289B2

(12) United States Patent
Modi et al.

(10) Patent No.: US 10,026,289 B2
(45) **Date of Patent: *Jul. 17, 2018**

(54) PREMISES MANAGEMENT SYSTEM WITH PREVENTION MEASURES

(71) Applicant: Google Inc., Mountain View, CA (US)

(72) Inventors: Yash Modi, San Mateo, CA (US); Kevin Charles Peterson, San Francisco, CA (US); Mark Rajan Malhotra, San Mateo, CA (US); Ken Herman, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/369,287

(22) Filed: Dec. 5, 2016

(65) Prior Publication Data

US 2017/0084147 A1 Mar. 23, 2017

Related U.S. Application Data

(63) Continuation of application No. 14/586,101, filed on Dec. 30, 2014, now Pat. No. 9,514,636.

(51) Int. Cl.

| | |
|---|---|
| ***G08B 21/00*** | (2006.01) |
| ***G08B 13/24*** | (2006.01) |
| ***G08B 31/00*** | (2006.01) |
| ***G08B 13/00*** | (2006.01) |
| ***G08B 29/00*** | (2006.01) |
| ***G08B 13/196*** | (2006.01) |
| ***G08B 29/18*** | (2006.01) |

(52) U.S. Cl.

CPC ..... *G08B 13/2491* (2013.01); *G08B 13/00* (2013.01); *G08B 13/19645* (2013.01); *G08B 29/00* (2013.01); *G08B 29/185* (2013.01); *G08B 31/00* (2013.01)

(58) Field of Classification Search

CPC ..... G08B 13/00; G08B 13/19645; G08B 13/2491; G08B 29/00; G08B 29/185; G08B 31/00; G08B 25/002; G08B 13/2494; G08B 29/046; G08B 13/1436

USPC ..... 340/507

See application file for complete search history.

(56) References Cited

U.S. PATENT DOCUMENTS 7,619,512 B2 11/2009 Trundle et al.
7,796,052 B2 9/2010 Katz (Continued)

OTHER PUBLICATIONS

Candamo, et al., "Understanding Transit Scenes: . . . ", IEEE Transactions on Intelligent Trans. Systems, IEEE, Piscataway, NJ, USA, vol. 11, No. 1, pp. 206-224.

(Continued)

*Primary Examiner* — Mark Rushing
(74) *Attorney, Agent, or Firm* — Morris & Kamlay LLP

(57) ABSTRACT

A system is provided including a plurality of inter-connected premises management devices, each including one or more sensors that generate data about an environment, and a control device to control one or more operations of the premises management system, the control device including a movement detector. The premises management system detects an attempt by an intruder to damage the control device based on data from the movement detector indicating an abnormal movement applied to the control device, historical data obtained from the sensors, and current data obtained from the sensors.

18 Claims, 4 Drawing Sheets

100

(56) References Cited

U.S. PATENT DOCUMENTS

| | | | | |
|---|---|---|---|---|
| 8,035,516 | B2 | 10/2011 | Edwards et al. | |
| 8,310,365 | B2 | 11/2012 | Siegler, II et al. | |
| 8,615,374 | B1 | 12/2013 | Discenzo | |
| 8,779,921 | B1 | 7/2014 | Curtiss | |
| 8,786,425 | B1 | 7/2014 | Hutz | |
| 9,013,294 | B1 | 4/2015 | Trundle | |
| 2003/0090374 | A1 | 5/2003 | Quigley | |
| 2004/0160324 | A1* | 8/2004 | Stilp ..... | G08B 25/008 340/572.1 |
| 2008/0036595 | A1 | 2/2008 | Hollstien et al. | |
| 2008/0079561 | A1 | 4/2008 | Trundle et al. | |
| 2009/0135007 | A1 | 5/2009 | Donovan et al. | |
| 2010/0208063 | A1 | 8/2010 | Lee et al. | |
| 2012/0133511 | A1 | 5/2012 | Blum et al. | |
| 2014/0184922 | A1 | 7/2014 | Schafer et al. | |
| 2014/0266674 | A1 | 9/2014 | Nye et al. | |
| 2014/0267112 | A1 | 9/2014 | Dunn et al. | |

OTHER PUBLICATIONS

International Search Report and Written Opinion dated Feb. 5, 2016 issued in PCT/US2015/062321.

Kuo, et al., "Design and Implementation . . . ", Computer Vision & Pattern Recognition Workshops (CVPRW), 2010 IEEE Computer Society Conf., IEEE, Piscataway, NJ, USA, Jun. 13, 2010 pp. 25-32.

Miljkovic, "Review of Novelty detection methods", 2010 Proceedings of the 33rd Int'l Convention, IEEE, Piscataway, NJ, USA, May 24, 2010, pp. 593-598.

Patino, et al., "Abnormal Behaviour Dectection . . . ", 2015 12th IEEE Int'l Conf. on Advanced Video and Signal Based Surveillance (AVSS), IEEE, Aug. 25, 2015, pp. 1-6.

IPRP dated Jul. 13, 2017 as received in Application No. PCT/US2015/062321.

* cited by examiner

PREMISES MANAGEMENT SYSTEM WITH PREVENTION MEASURES

BACKGROUND

Some homes today are equipped with smart home networks to provide automated control of devices, appliances and systems, such as heating, ventilation, and air conditioning ("HVAC") system, lighting systems, home theater, entertainment systems, as well as security systems. Smart home networks typically include central hubs or a control panel that provides a user interface for receiving user input and controlling the various devices, appliances, and security systems in the home.

Security systems in smart home networks typically include "entry delay" and "dialer delay" features to mitigate against false alarms. When an entry delay is implemented, entry through certain doors in the home may trigger a countdown of thirty seconds or more prior to activating the alarm in order to give the user time to enter the home, reach the control panel, and disarm the alarm. If the alarm is not disarmed in time, an alarm will sound in the home. Alternatively or in addition, a dialer delay may be implemented in which a signal may not be sent to a monitoring service or law enforcement entity for another thirty seconds or more in order to give the user additional time to disarm the alarm.

An intruder may be aware of these delay features and take advantage of the time that they afford. For example, the intruder may forcibly enter through a door which triggers a delayed entry countdown, locate the control panel, and attempt to destroy it in order to prevent the alarm from being activated and/or to prevent the system from sending out a signal to a monitoring system. Such tactics may be referred to as "smash-and-bash."

BRIEF SUMMARY

According to an embodiment of the disclosed subject matter, a premises management system may include a plurality of inter-connected premises management devices, each including one or more sensors that generate data about an environment, and a control device to control one or more operations of the premises management system, the control device including a movement detector, wherein the premises management system detects an attempt by an intruder to damage the control device based on data from the movement detector indicating an abnormal movement applied to the control device, historical data obtained from the sensors, and current data obtained from the sensors.

According to an embodiment of the disclosed subject matter, a method of detecting an attempt by an intruder to damage a control device of a premises management system may include obtaining sensor data, on an on-going basis, from a plurality of sensors that communicate with the premises management system, storing the sensor data obtained from the plurality of sensors as historical data, detecting an abnormal movement event associated with the control device, and determining that the abnormal movement event is an action initiated by the intruder based on a comparison of the historical data with sensor data obtained at about the time of the abnormal event.

According to an embodiment of the disclosed subject matter, means for detecting an attempt by an intruder to damage a control device of a premises management system are provided, include means obtaining sensor data, on an on-going basis, from a plurality of sensors that communicate with the premises management system, means for storing the sensor data obtained from the plurality of sensors as historical data, means for detecting an abnormal movement event associated with the control device, and means for determining that the abnormal movement event is an action initiated by the intruder based on a comparison of the historical data with sensor data obtained at about the time of the abnormal event.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
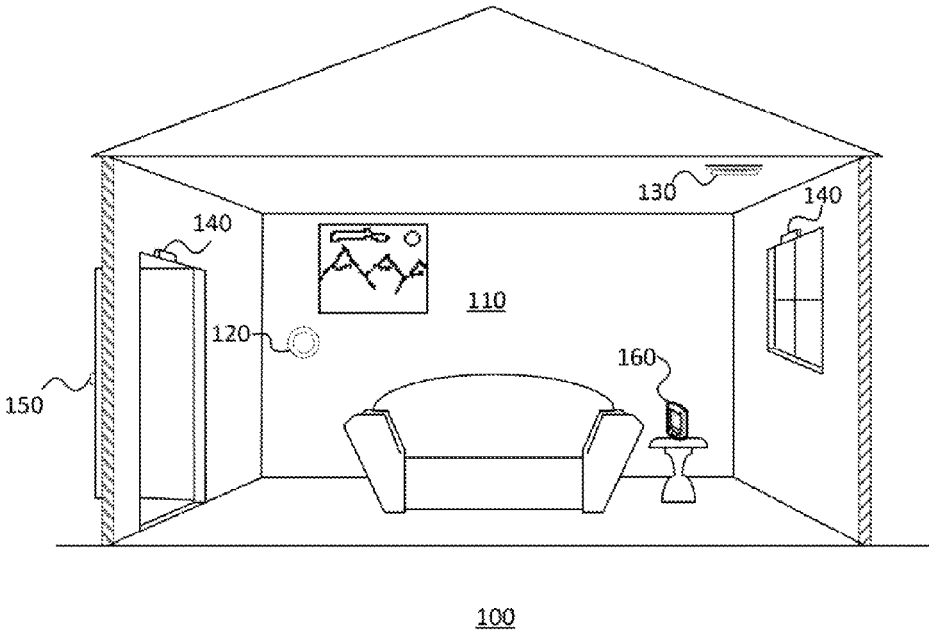
FIG. 1 shows a premises management system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosure may be practiced without these specific details, or with other methods, components, materials, etc. In other instances, well-known structures and devices are shown in block diagram form to facilitate describing the subject disclosure.

A security system of a smart home network may attempt to detect a smash and bash type attack by detecting vibrations or accelerations in the control panel; however, this technique leads to many false alarms, such as when a control panel is inadvertently bumped by an occupant of the home. Embodiments of the present disclosure generally relate to a system having features to detect a smash-and-bash type attack on a controller device and additional features to decrease the likelihood of false alarms based merely on abnormal movements of the controller device. Upon detection of an abnormal movement, the presently disclosed system may automatically and rapidly evaluate the nature of the potential threat. Depending upon the results, the system may respond accordingly, i.e., ignore false alerts, request confirmation from the user that all is well, or engage an alarm sequence.

The presently disclosed system may include a plurality of electrical and/or mechanical components, including intelligent, sensing, network-connected devices that communicate with each other and/or may communicate with a central server or a cloud-computing system to provide any of a variety of security (and/or environment) management objectives in a home, office, building or the like. Such objectives, which may include, for example, managing alarms, notifying third parties of alert situations, managing door locks, monitoring the premises, etc., will collectively be referred to as "premises management." A premises management system as disclosed herein may further include subsystems that communicate with each other to manage different aspects of premises management aside from security. For example, a security system component may manage the arming, disarming, and activation of alarms and other security aspects of the premises, and a smart home component may handle environmental aspects such as light, temperature, and hazard detection of the premises.

The individual hardware components of the presently disclosed system that are used to monitor and affect the premises in order to carry out premises management will hereinafter be referred to as "premises management devices." The premises management devices described herein include multiple physical hardware and firmware configurations, along with circuitry hardware (e.g., processors, memory, etc.), firmware, and software programming that are capable of carrying out the presently described methods and functions of a premises management system, particularly a security component thereof having features to distinguish between a true smash-and-bash attack and a false alert.

The premises management devices may be controlled by a "brain" component, as described below, which may be implemented in a controller device. As such, the controller device is often the target of smash-and-bash attacks. In addition to the measures described herein, such attacks may be mitigated against in some embodiments by distributing the brain component functionality among one or more premises management devices within the system as well as the controller device.

FIG. 1 shows an example premises management system 100, installed within a premises 110. The system 100 may include multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles 150, and one or more intelligent, multi-sensing, network-connected controller devices 160.

Generally, the system 100 may be configured to operate as a learning, evolving ecosystem of interconnected devices. New premises management devices may be added, introducing new functionality or expanding existing functionality. Existing premises management devices may be replaced or removed without causing a failure of the system 100. Such removal may encompass intentional or unintentional removal of components from the system 100 by the user, as well as removal by malfunction (e.g., loss of power, destruction by intruder, etc.). In view of the dynamic nature of the system, the overall functionality and objectives of the system 100 may change as the constitution and configuration of the system 100 change.

In order to avoid contention and race conditions among the interconnected devices, certain decisions, such as those that affect the premises management system 100 at a system level or that involve data from multiple sources, may be centralized in the aforementioned "brain" component. The brain component may coordinate decision making across the system 100 or across a designated portion thereof. The brain component is a system element at which, for example, detector states converge, user interaction is interpreted, sensor data is received and decisions are made concerning the state of the system 100. Hereinafter, the system 100 brain component will be referred to as the "primary system processor." The primary system processor may be implemented in the controller device 160 and/or distributed among one or more premises management devices within the system.

The primary system processor may control subsystems and components of the premises management system, such as, for example, the security component and/or the smart home environment component. Furthermore, the primary system processor may control, receive data from, and transmit data to premises management devices within the system.

In the embodiments disclosed herein, each of the premises management devices may include one or more sensors. In general, a "sensor" may refer to any device that can obtain information about its local environment and communicate that information in the form of data that may be stored or accessed by other devices and/or systems. Sensor data may form the basis of inferences drawn about the sensor's environment. For example, the controller device 160 and/or the primary system processor may use data from a plurality of sensors to determine whether an actual intruder is attempting to damage the controller device 160 or whether an innocuous or accidental event is taking place, that is, to distinguish a true smash-and-bash attack from a false alert.

A brief description of sensors that may be included in the system 100 follows. Examples provided are not intended to be limiting but are merely provided as illustrative subjects to help facilitate describing the subject matter of the present disclosure. The system 100 may use data from the types of sensors described below in order to detect a true smash-and-bash type attack, but the present disclosure is not limited to using the types of example sensors listed here. Rather, the system 100 may employ data from any type of sensor that provides data from which an inference may be drawn about the environment in or around the premises 100 and the vicinity of the controller device 160. Since it would be impractical to list and describe every type of possible sensor, it should be understood that sensors in general are known in the art and deployment of sensors not specifically described herein will be readily understood by one of ordinary skill on the art.

Generally, sensors may be described by the type of information they collect. For example, sensor types may include motion, smoke, carbon monoxide, proximity, temperature, time, physical orientation, acceleration, location, entry, presence, pressure, light, and sound, sensors and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof.

A sensor also may be described in terms of a function or functions the sensor performs within the system 100. For example, a sensor may be described as a security sensor when it is used to determine security events, such as unauthorized entry.

A sensor may operate for different functions at different times. For example, system 100 may use data from a motion sensor to determine how to control lighting in the premises 100 when an authorized user is present and use the data to change a system security state on the basis of unauthorized or unexpected movement when no authorized user is present. In another example, the system 100 may use the motion sensor data differently when an alarm system is in an "armed" state versus an "unarmed" state.

In some cases, a sensor may operate as multiple sensor types sequentially or concurrently, such as where a temperature sensor is used to detect a change in temperature, as well as the presence of a person or animal. A sensor also may operate in different modes (e.g., different sensitivity or threshold settings) at the same or different times. For example, a sensor may be configured to operate in one mode during the day and another mode at night. As another example, a sensor may operate in different modes based upon a state of system 100, or as otherwise directed by the primary system processor.

Multiple sensors may be arranged in a single physical housing, such as where a single device includes movement, temperature, magnetic, and/or other sensors. Such a housing may also be referred to as a sensor or a sensor device. For clarity, sensors may be described with respect to the particular functions they perform and/or the particular physical hardware used, when such specification is beneficial for understanding of the embodiments disclosed herein.

Figure 2:
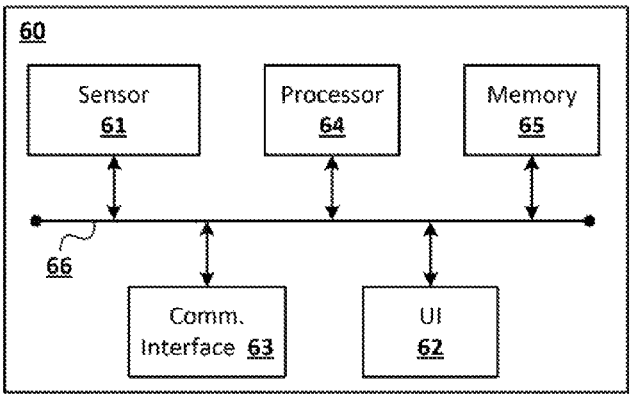
FIG. 2 shows a premises management device according to an embodiment of the disclosed subject matter.

FIG. 2 shows an example premises management device 60 including a sensor 61 as disclosed herein. The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, compass or any other suitable environmental sensor, that obtains or provides a corresponding type of information about the environment in which the premises management device 60 is located. A processor 64 may receive and analyze data obtained by the sensor 61, control operation of other components of the premises management device 60 and/or external devices, and process communication between the premises management device 60 and other devices. The processor 64 may execute instructions and/or computer executable components stored on a computer-readable memory 65. Such computer executable components may include, for example, a primary function component to control a primary function of the premises management device 60 related to managing a premises, a communication component to locate and communicate with other compatible premises management devices, and a computational component to process system related tasks.

The memory 65 or another memory in the premises management device 60 may also store environmental data obtained by the sensor 61. A communication interface 63, such as a WiFi, Thread, or other wireless interface, Ethernet or other local network interface, Bluetooth® or other radio interface, or the like may allow for transmission and receipt of data by the premises management device 60 to and from other devices.

A user interface (UI) 62 may provide information and/or receive input from a user of system 100. The UI 62 may include, for example, a speaker to output an audible alarm when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, or limited-output display, or it may be a full-featured interface such as a touchscreen, keypad, or selection wheel with a click-button mechanism to enter input.

Internal components of the premises management device 60 may transmit and receive data to and from one another via an internal bus 66 or other mechanism, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 obtains data about the premises, and at least some of the data may be used to distinguishably identify a true smash-and-bash type attack, as will be described below. Through the bus 66 and/or communication interface 63, sensor data may be transmitted to or accessible by other components of the system 100. Generally, two or more sensors on one or more premises management devices may generate data that can be coordinated by the primary system processor to determine a system response and/or infer a state of the environment. In one example, the primary system processor of the system 100 may infer a state of intrusion based on data from entry detection sensors and motion sensors and, based on the determined state, further determine whether an intruder is present and whether a smash-and-bash attack is occurring.

Figure 3:
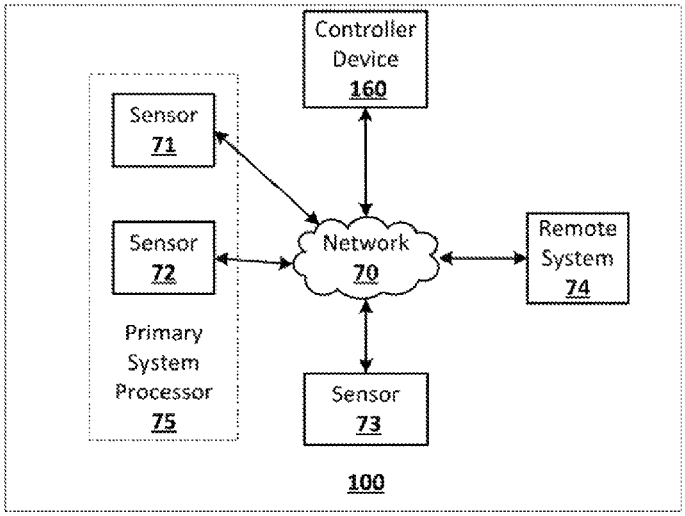
FIG. 3 shows a system according to an embodiment of the disclosed subject matter.

FIG. 3 shows a diagram example of a premises management system 100 which may include distinguishing smash-and-bash detection features as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. A user may therefore interact with the premises management system 100, for example, using the controller device 160 which communicates with the rest of the system 100 via network 70.

The controller device 160 and/or one or more of the sensors 71, 72, 73, may be configured to implement a primary system processor 75. The primary system processor 75 may, for example, receive, aggregate, and/or analyze environmental information received from the sensors 71, 72, 73, and the controller device 160. Furthermore, a portion or percentage of the primary system processor 75 may be implemented in a remote system 74, such as a cloud-based reporting and/or analysis system.

The sensors 71, 72, 73, may be disposed locally to one another, such as within a single dwelling, office space, building, room, or the like, or they may be disposed remote from each other, such as at various locations around a wide perimeter of a premises. In some embodiments sensors 71, 72, 73, may communicate directly with one or more remote systems 74. The remote system 74 may, for example, aggregate data from multiple locations, provide instruction, software updates, and/or aggregated data to the primary system processor 75, controller device 160, and/or sensors 71, 72, 73. In addition, remote system 74 may refer to a system or subsystem that is a part of a third party monitoring service or a law enforcement service.

The premises management system shown in FIG. 3 may be a part of a smart-home environment. The smart-home environment may include a structure, such as a house, office building, garage, mobile home, or the like. The devices of the smart home environment, such as the sensors 71, 72, 73, and the network 70 may be integrated into a smart-home environment that does not include an entire structure, such as a single unit in an apartment building, condominium building, or office building.

As alluded to above, the smart home environment can control and/or be coupled to devices both inside and outside of the premises structure. For example, one or more of the sensors 71, 72, 73, may be located outside the structure at one or more distances from the structure (e.g., sensors 71, 72, may be disposed at points along an extended driveway or land perimeter on which the structure is located, and the like). Likewise, the primary system processor 75 may be implemented in sensors located outside of the structure. The controller device 160 may also be implemented as a device integrated within the structure or as a free-standing device independent of the structure which the user may carry within or outside of the structure.

The structure of the smart-home environment may include a plurality of rooms, separated at least partly from each other via walls. Each room can further include a floor and a ceiling. Devices of the smart-home environment, such as the sensors 71, 72, 73, may be mounted on, integrated with and/or supported by a wall, floor, or ceiling of the structure.

Figure 4:
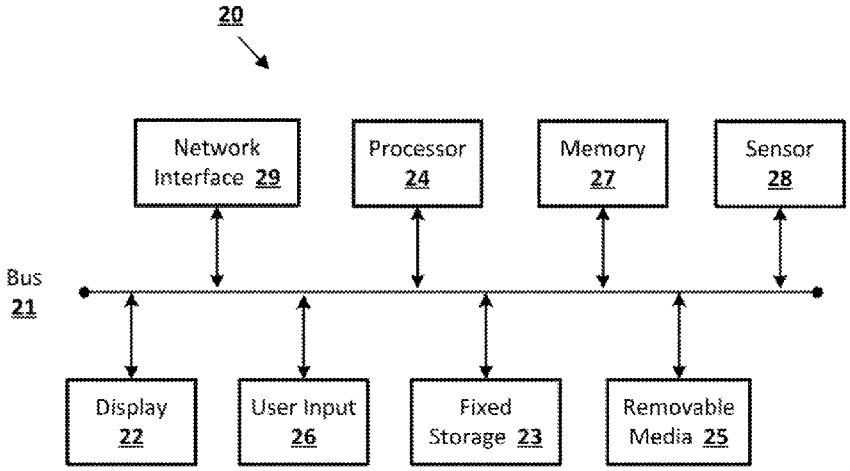
FIG. 4 shows a computing device according to an embodiment of the disclosed subject matter.

FIG. 4 shows an example computing device 20 suitable for implementing certain elements that are a part of embodiments of the presently disclosed subject matter. The computing device 20 may be used to implement, for example, the controller device 160 or a premises management device including sensors as disclosed above. The computing device 20 may be constructed as a custom-designed device or may be, for example, a special-purpose desktop computer, laptop computer, or mobile computing device such as a smart phone, tablet, or the like.

The computing device 20 may include a bus 21 that interconnects major components of the computing device 20, such as a central processor 24, a memory 27 such as Random Access Memory (RAM), Read Only Memory (ROM), flash RAM, or the like, a sensor 28, which may include one or more sensors as previously discussed herein, a user display 22 such as a display screen, a user input interface 26, which may include one or more user input devices such as a keyboard, mouse, keypad, touch screen, turn-wheel, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computing device 20 are generally stored on and accessed via a computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol as will be readily understood by one of skill in the art, including digital cellular telephone, WiFi, Thread, Bluetooth®, near-field, and the like. For example, the network interface 29 may allow the computing device 20 to communicate with other components of the premises management system, other computers via one or more local, wide-area, or other communication networks, as described in further detail herein.

Referring to FIGS. 3 and 4, as mentioned above, computing device 20 may be used to implement a controller device 160 of the system 100. In implementation as a controller device 160, computing device 20 may include one or more sensors 28 to detect events that are indicative of a possible smash-and-bash attack. For example, sensor 28 may be a movement detector 28 to detect movement of the computing device 20. The movement detector 28 may be implemented as, for example, an accelerometer, a magnetic sensor and compass, a shock detector, a PIR, or the like. More generally, the movement detector 28 may include one or more sensors as disclosed herein or a combination of such sensors, sufficient to detect movement of the controller device.

The movement detector 28 may detect movement of the computing device 20 and generate data indicative of an intensity of any detected movement as well as a lack of movement. The computing device 20 may store the data in intervals on an on-going basis, for example, in fixed storage 23, removable media 25, or in a storage external to the computing device 20 via network interface 29. Moreover, movement data may be stored in association with a timestamp indicating a time that the data was generated. Immediately stored movement data, such as the most-recently stored data, may be referred to as "current movement data," while stored data which is no longer current may be referred to as "historical movement data."

Historical movement data may remain stored for a predetermined amount of time. For example, to conserve storage space the computing device 20 may be configured to store historical movement data for a period of one week, after which the data is deleted. This period of time may be adjusted by the user or automatically by the computing device 20 in accordance with available storage space.

The computing device 20 may estimate a range of normal movement of the computing device 20 based at least in part on the historical movement data. The estimation may be based on, for example, an average measure of intensity of movement per unit of time as indicated by the historical data for a given time period, plus or minus the standard deviation, or based on simpler or more complex algorithms/formulas. Moreover, the estimation method may be defined separately for different segments of the day, i.e., morning, noon, afternoon, evening, and night standards, and/or further take into account days of the week. For example, the normal movement range for Saturday afternoon, when the residents of a house are all at home, may be different than the normal movement range for a Monday afternoon, when all of the residents are typically out at school and work.

The computing device 20 may include multiple types of movement detectors 28. In such an embodiment, the estimated range of normal movement may further be determined per sensor of the computing device 20. For example, a first sensor may be an accelerometer, which may frequently detect slight movements (e.g., when the computing device 20 is picked up and moved around) over a subject time period while a second sensor may be a shock detector which may rarely detect impact above a certain threshold (e.g., the computing device 20 is rarely dropped) during the same time period. A third sensor may be an anti-tamper sensor, which may never detect an attempt to pry open the computing device 20 over the same time period, thereby resulting in estimated ranges of normal movement unique for each sensor type.

The range estimation may be stored (e.g., as one or more values) and updated periodically on an on-going basis or updated on an event basis, for example, before deleting any historical movement data.

The current and historical movement data may also be accessible by the premises management system (i.e., by the primary system processor which handles computational tasks of the system). Based on the historical movement data, the premises management system may independently estimate a range of normal movement of the computing device 20 and/or access the range as defined by the computing device 20. For example, the primary system processor may have greater processing power and execute more complex algorithms to refine the range estimation. In either case, both the computing device 20 and the premises control system may have a data reference that represents an estimation of normal movement range of the computing device 20.

In addition, the estimate of the premises management system may take into account additional data available from sensors 71, 72, 73, external to the computing device 20. A range of normal movement that is estimated based on additional data obtained from sensors 71, 72, 73, outside of the computing device 20 may be referred to as an "extended estimation."

An extended estimation may factor in data obtained from sensors 71, 72, 73, of any of the premises management devices in the premises management system 100. The scope of the extended estimation is limited only by the availability of sensor data and the computational power available to the system for processing the data. Current and/or historical sensor data from any of the sensors 71, 72, 73, located in and/or around the premises may be associated, e.g., by time, with the historical movement data of the computing device 20, thereby allowing execution of algorithms which produce more complete estimations of normal movement. For example, the premises management system 100 may include one or more sensors 71, 72, 73, in each room of a premises. Based on periodic communication with these sensors 71, 72, 73, the location of the computing device 20 within the premises may be tracked. Data indicating a location of the computing device 20 may be referred to as "tracking data." Tracking data may also include a timestamp indicating a time that the tracking data was recorded.

Since tracking data may be associated with historical movement data having a corresponding timestamp, an extended estimation may define normal movement relative to a particular room of the premises. For example, if the computing device 20 is left in a family room or play room, certain acceleration movements, bumps, drops, etc. might be normal, whereas if the computing device 20 is left in a study, long periods of stillness might be normal. This is only one example use of external sensor data to supplement an extended estimation. Numerous other types of correspondence of data to produce an extended estimation are possible. An extended estimation may therefore include a matrix of data taking into account a plurality of factors representing a variety of aspects of the premises.

The accuracy of the normal range estimations and extended estimations may improve over time. As more data from the sensors 71, 72, 73, in the premises is generated, the system 100 better "learns" the normal conditions of the environment. Additional learning may occur by the premises management system 100 maintaining a record of the circumstances (e.g., time of day, location within the premises, etc.) of false smash-and-bash alarms as part of the extended estimation. Such a record may factor into evaluations of abnormal movement, as will now be described.

When the computing device 20 experiences a movement that is abnormal, that is, not in accordance with the estimated normal range of movement, the computing device 20 may immediately transmit an alert to the premises management system 100. The alert may include the current movement data that represents the movement of the triggering event. An abnormal movement could be, for example, a sudden acceleration, a high-impact blow, or any type of movement that is outside of the estimated range of normal movement detectable by a given sensor 28 of the computing device 20. Based on the alert, the system 100 may infer that a smash-and-bash attack is potentially taking place. However, prior to responding as though an attack occurred (e.g., entering an alarm and reporting sequence, etc.) the system of the present disclosure may automatically evaluate one or more factors based on sensor data obtained from sources outside of the computing device 28 in order to improve the accuracy of identifying whether an attack is, in fact, occurring.

Figure 5:
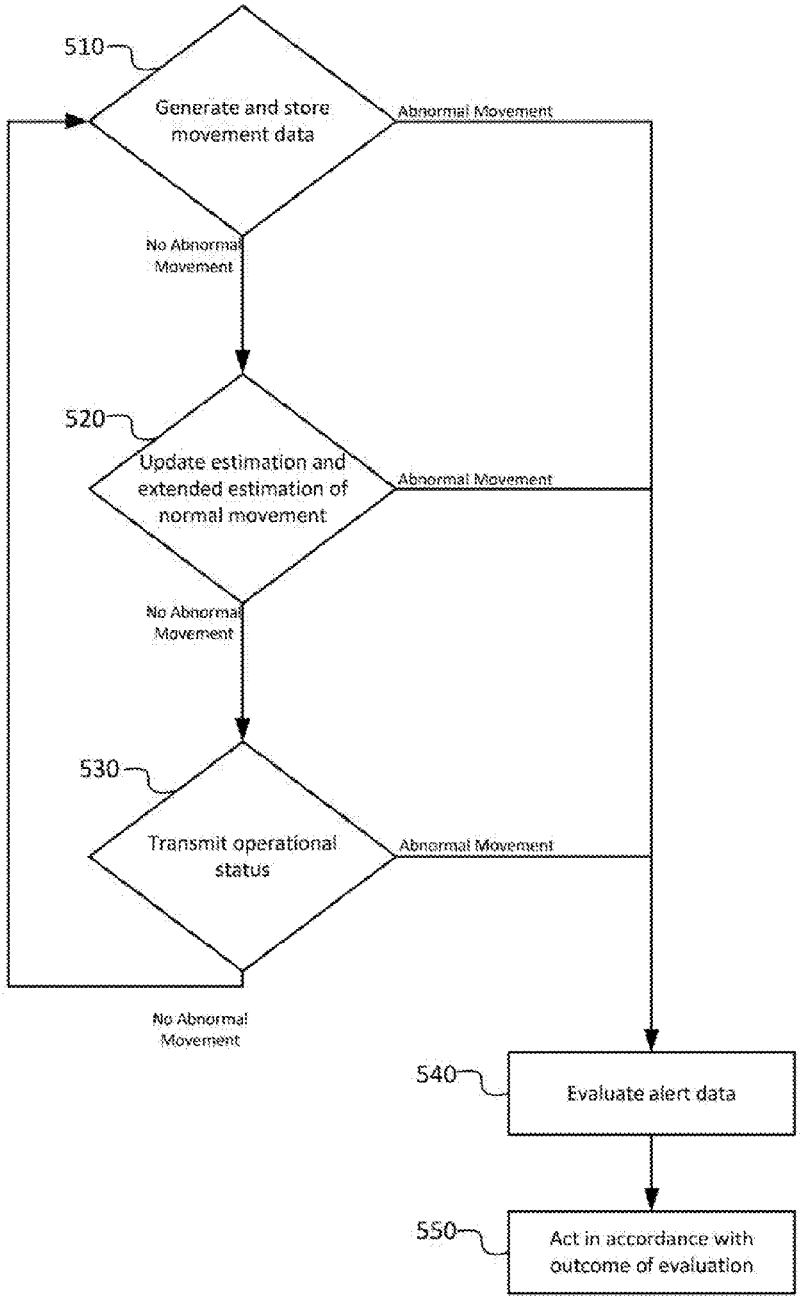
FIG. 5 shows a flowchart of a method of detecting a smash-and-bash attack according to the present disclosure.

FIG. 5 shows a flowchart of a method of distinguishably detecting a smash-and-bash type attack according to the present disclosure. At operation 510, the computing device 20 generates current movement data and stores the data as historical movement data. At operation 520 an estimation of normal movement is defined/updated based on historical movement data. An extended estimation of normal movement is also be defined/updated by the premises management system 100. At operation 530, the computing device 20 transmits an operational status of the device 20 to the system 100 and/or to an external system such as a monitoring service. The transmission may include data indicating a state of operation of the computing device 20, sensor data from sensor 28, current tasks of processor 24, or other types of data.

The computing device 20 continues to execute operations 510, 520, and 530 on an on-going basis. When, at any time, the computing device 20 detects an abnormal movement, the computing device 20 may immediately transmit an alert to the premises management system 100 along with the current movement data at operation 540. At operation 540 the system 100 automatically executes an evaluation of the alert data and other data, for example from other sensors 71, 72, 73, in the system 100, to determine whether to take any action in response to the alert. At operation 550 the system 100 acts in accordance with the result of the evaluation.

The evaluation operation may be executed in any number of ways. In one embodiment, the evaluation culminates in an event score which determines what, if any, action the system will take in response to the alert.

The operations of the evaluation may depend on the data and resources available to the premises management system 100. Several examples of how the evaluation may be executed will be provided, however, since the exact capabilities of the system may vary per implementation, the subject matter of the present disclosure is not limited to these examples. Generally, the system 100 may identify and weight factors based on data derived from any available data source outside of the computing system 28, generate an event score based on the weighted factors, and respond appropriately according to the result.

The estimation of abnormal movement received from the computing device 20 may be a first factor that is weighted in the evaluation. For example, this may be the first indication of a potential attack and may be accorded a default weight value.

If the premises management system 100 has generated an independent extended estimation, then the extended estimation may be another factor that is included in the evaluation. The system 100 may check the abnormal movement against the extended estimation, since the two may not necessarily indicate identical conclusions. For example, if the computing device 20 issues the alert in the playroom at 4:00 PM, the system 100 may check the extended estimation data. The system 100 may have "learned" that this is a time and location of high activity, therefore the extended estimation may have a greater range of normal movement that would not classify the current movement data as abnormal for the circumstances.

Sensor data from one or more sensors 71, 72, 73 may be another factor that is included in the evaluation. For example, based on historical data obtained from the sensors 71, 72, 73, as well as current movement data obtained from the computing device 20 at or around the time of the abnormal movement detection, the premises management system 100 may infer whether an individual is likely present in the vicinity of the computing device 20 and if so, whether the individual is likely to be an authorized individual or an intruder.

The lack of receiving an operational status update may be another factor that is included in the evaluation. For example, if the computing device had been regularly transmitting the operational status in fifteen minute intervals but the last transmission has not yet timely arrived, this may indicate that something has happened to the computing device 20. The system 100 may store a local log of the operational status updates or such a log may be stored in remote server 74 and accessed by the system 100 when needed.

Two or more of these and other such factors may be weighted and combined into an event score according to any of various techniques. In a simplest technique, each factor may be weighted equally and increment or decrement the event score from a default value in accordance with whether the factor indicates that a smash-and-bash attack is occurring. In a more complex technique, each factor may weighted against a reference factor depending upon how much relevant data the factor includes.

Figure 6:
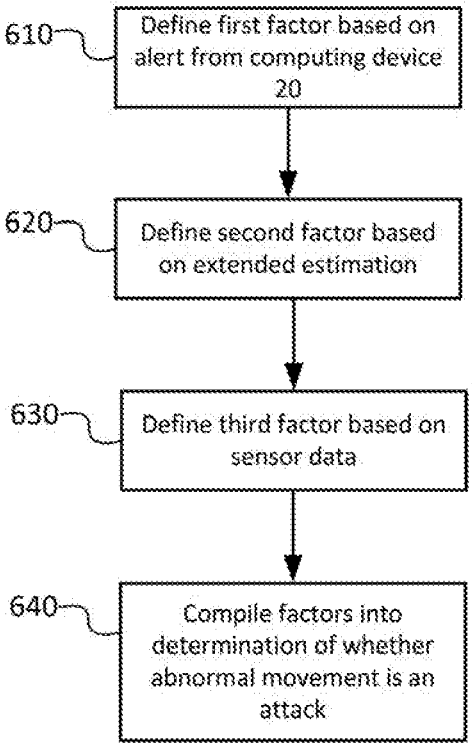
FIG. 6 shows a flowchart of an example evaluation operation.

FIG. 6 shows a flowchart of an example evaluation operation. Although the description includes terms such as "first factor," "second factor," etc., these terms are used for the purpose of distinguishing elements and are not intended to limit the operation to any particular order. A person of ordinary skill in the art will recognize that the operations need not proceed in the order presented and that various operations may be executed before or after other operations. Furthermore, the evaluation may comprise a greater or lesser number of operations in accordance with speed requirements and computational ability of the system 100.

At operation 610 the premises management system 100 receives the alert and the current movement data from the computing device 20 and may initiate an evaluation by defining the alert as a first factor indicating that an attack is occurring.

At operation 620 the system 100 checks the current movement data from the computing device 20 against the extended estimation defined by the system 100 as a second factor. If the current movement data falls outside of the range of normal movement according to the extended estimation, then the second factor indicates that an attack is occurring. Otherwise, the second factor indicates that an attack is not occurring.

At operation 630, the premises management system 100 accesses data from one or more sensors 71, 72, 73, of premises management devices. This data access may include current and historical data from the sensors 71, 72, 73. The historical data may cover a predetermined time period so as to limit the amount of data. Furthermore, this data access may be a system-wide access or a limited, focused data access. For example, the system may first determine whether it is possible to determine where the computing device 20 is located. The location may be determined, for example, based on a system variable (i.e., where the last known location is stored in a system variable) or based on data from the premises management device which most recently received the operational status transmission of the computing device 20.

If the computing device 20 may be located, the system may access current data and/or historical data from sensors 71, 72, 73, in the vicinity of the last known location of the computing device 20, e.g., collocated in the same room with the computing device 20. The accessed data may further be chronologically limited to the data corresponding to the time or about the time that the abnormal movement occurred, for example within a ten second time range, a ten minute time range or any other predetermined time period during which sensor data may be causally linked to the time that the abnormal movement occurred. For example, data from sensors 71, 72, 73, that are physically more distant from the computing device 20 may be used from points farther in time from the abnormal movement, while data from sensors 71, 72, 73, located in the same room as the computing device 20 may be limited to only the most recent sensor readings.

By further limiting the data access a speed of the evaluation operation may be increased. Based on the accessed data, the system 100 may determine whether unusual activity has occurred in the vicinity of the computing device 20. Thus, the data may serve as a factor for or against inferring the presence an intruder, and by extension, for or against a determination of an attack presently occurring. For example, the data may indicate that that a window in the room was recently broken or forcibly opened, that an individual has entered the room in an unusual way, that an individual has entered the room at an unusual time (i.e., during the night when everyone is normally asleep or during the afternoon when everyone is normally away), or some other unusual, individual behavior. In any of these cases, the data from sensors 71, 72, 73, may be a third factor that indicates an attack is occurring. Conversely, if the data from sensors 71, 72, 73, in the vicinity of the computing device 20 indicate that no individual is in the room at all, that only authorized individuals are in the room, or otherwise indicates that all is well, then the data from sensors 71, 72, 73, may be a third factor that indicates that an attack is not occurring.

If the computing device 20 cannot be located, the system may access data from sensors 71, 72, 73, of any premises management device and check whether any other alerts have recently been issued or any indication of potential intrusion has occurred anywhere in or around the premises.

At operation 640 the premises management system 100 may compile the results of the evaluation and determine whether a smash-and-bash attack is likely to be presently taking place. This compilation may be a simple summation of the "for" and "against" factors, where "for" is represented as a positive value and "against" is represented as a negative value. Other more complex compilation techniques may be used. For example, each of the factors may be weighted based on, for example, relevance (e.g., how close the data source is to the computing device 20), reliability (e.g., has the factor has led to false alarms in the past), or other considerations.

Using the score model, the system may define threshold scores of response. Different responses may be appropriate for different ranges of scores. For example, if the score falls below a first threshold value, the system will ignore the event. If the score is between the first threshold value and a second threshold value, the system will further investigate the event. If the score is above the second threshold value, the system will immediately initiate an alarm sequence and notify the monitoring service and/or law enforcement agency.

For example, an evaluation of an alert may result in three factors: 1—the alert that indicates an abnormal movement, 2—an extended estimation that further indicates the movement is abnormal for the time of day and room in which it takes place, and 3—sensor data that indicates that an individual has broken a window and entered the room in which the computing device 20 was most recently located. If the factors are each accorded a weight of "10", then the evaluation may result in an event score of 30. In this case, the second threshold may have been predetermined to be 20, and accordingly system would initiate an alarm sequence.

In another example, an evaluation of an alert may result in: 1—the alert that indicates an abnormal movement, 2—an extended estimation that indicates the movement is normal for the time of day and room in which it takes place, and 3—sensor data that indicates that an individual is present in the room which the computing device 20 was most recently located. If the factors are each accorded a weight of "10", then the evaluation may result in an event score of 20. In this case, again, the second threshold may be 20. Since the event score is not greater than the second threshold, the system may initiate an intermediate response. For example, the computing device 20 may display a yellow "warning" color or request input (e.g., a security code) from the user to confirm to the system that the computing device 20 has not been damaged. If the requested response from the computing device 20 is not forthcoming or does not indicate all is well, the system may proceed to enter into the alarm sequence.

Accordingly, by factoring historical and current data obtained from sensors 71, 72, 73 outside of the computing device 20, the system 100 may leverage data from multiple sources to reach a more accurate conclusion as to whether a smash-and-bash is taking place.

In the system 100, the data may be obtained from sensors 71, 72, 73, show in FIG. 3 which may be included in a plurality of devices, including intelligent, multi-sensing, network-connected devices, that can integrate seamlessly with each other and with a central processor (e.g., primary system processor 75) and/or a cloud-computing system (e.g., remote system 74) to provide general home-security and features of a smart-home environment. For example, the smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). These and other premises management devices may execute a primary function in the smart-home environment unrelated to security, however, a security component of the premises management system 100 may operate as described above to obtain data from these devices to improve the accuracy of identifying a smash-and-bash attack.

For example, data may be obtained from a smart doorbell that may control doorbell functionality, detect a person's approach to or departure from a location (e.g., an outer door to the structure), and announce a person's approach or departure from the structure via audible and/or visual message that is output by a speaker and/or a display coupled to, for example, the controller device 160.

As another example, data may be obtained from a smart thermostat that may detect ambient climate characteristics (e.g., temperature and/or humidity) as well as control an HVAC (heating, ventilating, and air conditioning) system accordingly of the structure.

As another example, data may be obtained from a smart hazard detector that may detect the presence of a hazardous substance or a substance indicative of a hazardous substance (e.g., smoke, fire, or carbon monoxide). Although not directly related to identifying an intruder, such data may still be used to identify an unusual circumstance within the premises.

In embodiments of the disclosed subject matter, a system 100 may include one or more intelligent, multi-sensing, network-connected entry detectors (e.g., "smart entry detectors"). Such detectors may be or include one or more of the sensors 71, 72, 73, shown in FIG. 3. The illustrated smart entry detectors (e.g., sensors 71, 72, 73,) may be disposed at one or more windows, doors, and other entry points of the smart-home environment for detecting when a window, door, or other entry point is opened, broken, breached, and/or compromised. Data may be obtained from such smart entry detectors and used, for example, to identify unusual entry as a factor of the evaluation in operation 630 of FIG. 6.

In some embodiments, the premises management system 100 shown in FIG. 3 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72, 73, shown in FIG. 3. Thus, data may be obtained from a smart wall switch that may detect ambient lighting conditions for a primary function of controlling a power and/or dim state of one or more lights. For example, a sensor such as sensors 71, 72, 73, may detect ambient lighting conditions, and a device such as the controller device 160 may control the power to one or more lights (not shown) in the smart-home environment. Depending on the complexity of the evaluation algorithms, ambient lighting conditions may be a factor to consider in identifying unusual circumstances, e.g., consider whether the abnormal movement occurring in a dark room wherein there is normally no movement in darkness.

Data may also be obtained from smart wall switches that may also control a power state or speed of a fan, such as a ceiling fan. For example, sensors 71, 72, 73, may detect the power and/or speed of a fan, and the controller device 160 may adjust the power and/or speed of the fan, accordingly. Smart wall plugs may control supply of power to one or more wall plugs (e.g., such that power is not supplied to the plug if nobody is detected to be within the smart-home environment). For example, one of the smart wall plugs may control supply of power to a lamp (not shown).

The smart-home environment of the sensor network shown in FIG. 3 can include one or more intelligent, multi-sensing, network-connected doorknobs (e.g., "smart doorknob"). For example, the sensors 71, 72, 73, may be coupled to a doorknob of a door (e.g., doorknobs 122 located on external doors of the structure of the smart-home environment). However, it should be appreciated that smart doorknobs can be provided on external and/or internal doors of the smart-home environment. Data about the status of the doorknobs may be obtained an combined with other data to infer a state of a room or the premises.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72, 73, of FIG. 3) can be communicatively coupled to each other via the network 70, and to the controller device 160 and/or remote system 74 to provide security, safety, and/or comfort for the smart home environment. However, these and other elements may be used for the secondary purpose of distinguishing smash-and-bash attacks.

The system 100 may obtain data from one or more of the network-connected smart devices, however, the user also may interact with such devices (e.g., via the network 70). For example, a user can communicate using computing device 20 (e.g., in the form of controller device 160), a portable electronic device (e.g., a smartphone, a tablet, a key FOB, or the like), or a computer (e.g., a desktop computer, laptop computer, tablet, or the like). A webpage or application can be configured to receive communications from the user and control the one or more of the network-connected smart devices based on the communications and/or to present information about the device's operation to the user. For example, the user can view, arm or disarm the security system of the home. Similarly, the user may also access a report of the sensor data. The system 100 may provide control functions related to the sensor data, for example, to limit the length of time sensor data is stored, to clear caches for privacy concerns, or to disable the storing of data.

Furthermore, more than one user may control one or more of the network-connected smart devices in the smart-home environment using a network-connected computer or portable electronic device. In some examples, some or all of the users (e.g., individuals who live in the home) can register their mobile device and/or key FOBs with the smart-home environment. Such registration can be made via the controller device 160, a computer in communication with the system 100, and/or a central server such as the remote system 74. Registration may be used to authenticate the users and/or their electronic devices as being associated with the smart-home environment, and to provide permission to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment. Such a use may be an event that generates data which may be used in evaluating alerts from the computing device 20, e.g., the use may indicate the presence of an authorized individual.

Alternatively, or in addition to registering electronic devices, the smart-home environment may make inferences about which individuals live in the home and are therefore users and which electronic devices are associated with those individuals. The smart-home environment may "learn" who is a user (e.g., an authorized individual) and permit the electronic devices associated with those individuals to control the network-connected smart devices of the smart-home environment (e.g., devices communicatively coupled to the network 70). In this embodiment, various types of notices and other information, such as the verification response sent after an evaluation results in an intermediate event score, may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to the system 100 or a cloud-computing system (e.g., remote system 74) regarding detected movement and/or presence of people, animals, and any other objects and receives back commands for controlling the lighting accordingly. It follows that data of such detections may be used as a factor in evaluating alerts from the computing device 20.

In some configurations, a remote system 74 may aggregate data from multiple locations, such as multiple buildings, multi-resident buildings, individual residences within a neighborhood, multiple neighborhoods, and the like. In general, sensors 71, 72, 73, and/or controller device 160 as previously described with respect to FIG. 3 may provide information to the remote system 74. The system 100 may provide data directly from one or more sensors as previously described, or the data may be aggregated and/or analyzed by local controllers such as the primary system processor 75, which then communicates with the remote system 74. The remote system 74 may aggregate and analyze the data from multiple locations, and may provide aggregate results to each location. For example, the remote system 74 may examine larger regions for common sensor data or trends in sensor data, and provide information on the identified commonality or environmental data trends to each local system 100. Such trend data may also be used as factors in evaluating alerts from the computing device 20.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A premises management system, comprising:

a control device configured to control one or more operations of the premises management system, the control device including a movement detector configured to generate a signal indicative of an intensity of any detected movement of the control device, a receiver to receive data from one or more external sensors, and a processor configured to determine whether a physical attack on the control device has occurred based on: (1) a signal generated by the movement detector that indicates detected movement above a threshold intensity amount, and (2) the data from the one or more external sensors, wherein the processor determines that the physical attack on the control device has occurred by generating a score based on weighting a plurality of factors, the plurality of factors including at least the data from the one or more external sensors and at least one factor among the plurality of factors is weighted based on a distance of a source of the factor from the control device.

2. The premises management system of claim 1, wherein the processor is further configured to transmit a signal to the premises management system to select a different device to function as the control device when the score is above a first threshold.

3. The premises management system of claim 1, wherein the plurality of factors includes the signal that indicated detected movement.

4. The premises management system of claim 1, wherein the plurality of factors includes historical data generated by the one or more external sensors.

5. The premises management system of claim 1, wherein a first source that is disposed closer to the control device than a second source is given greater weight than the second source.

6. The premises management system of claim 1, wherein at least one factor among the plurality of factors is weighted based on a reliability estimation of a source of the at least one factor.

7. The premises management system of claim 6, wherein the reliability estimation is based on historical data indicating that the source has provided data that led to one or more false alarms.

8. The premises management system of claim 1, wherein at least one of the one or more external sensors is a network connected wall switch.

9. The premises management system of claim 1, wherein at least one of the one or more external sensors is a network connected thermostat.

10. The premises management system of claim 1, wherein at least one of the one or more external sensors is a network connected hazard detector.

11. The premises management system of claim 1, wherein the one or more external sensors are located in a different room of the premises than the control device.

12. A method of detecting and handling a physical attack on a control device of a premises management system, comprising:

generating, by a control device, a signal indicative of an intensity of detected movement of the control device;

receiving, by the control device, data from external sensors, the data indicating a state or condition of a premises; and when the signal indicates detected movement above a threshold intensity level, generating a score based on weighting a plurality of factors, the plurality of factors including at least the data from the one or more external sensors, and determining that a physical attack on the control device has occurred based on the score, wherein at least one factor among the plurality of factors is weighted based on a distance of a source of the factor from the control device.

13. The method of claim 12, further comprising selecting a device other than the control device to execute the functions of the control device when the score is above a first threshold.

14. The method of claim 12, wherein the plurality of factors includes the signal that indicated detected movement.

15. The method of claim 12, wherein the plurality of factors includes historical data generated by the one or more external sensors.

16. The method of claim 12, wherein a first source that is disposed closer to the control device than a second source is given greater weight than the second source.

17. The method of claim 12, wherein at least one factor among the plurality of factors is weighted based on a reliability estimation of a source of the at least one factor.

18. The method of claim 17, wherein the reliability estimation is based on historical data indicating that the source has provided data that led to one or more false alarms.

* * * * *